US005237922A

United States Patent [19]

Ho

[11] Patent Number: 5,237,922

[45] Date of Patent: Aug. 24, 1993

[54] INK CUP FOR A PAD PRINTER

[76] Inventor: David W. M. Ho, 3 & 6th Floor, Block 1, Wah Shing Industrial Building, 12-14 Wah Shing Street, N.T. Hong Kong, Hong Kong

[21] Appl. No.: 831,540

[22] Filed: Feb. 5, 1992

[30] Foreign Application Priority Data

May 28, 1991 [GB] United Kingdom ..... 9111459

[51] Int. Cl.[5] ..... B41K 1/42

[52] U.S. Cl. ..... 101/333; 101/163

[58] Field of Search ..... 101/103, 108, 109, 110, 101/327, 333, 405, 406, 368, 125, 364, 163

[56] References Cited

U.S. PATENT DOCUMENTS

| | | | |
|---|---|---|---|
| 3,444,808 | 5/1969 | Schwartzman | 101/125 |
| 4,009,657 | 3/1977 | Bonanno et al. | 101/157 |
| 4,262,426 | 4/1981 | Miyazaki | 101/333 |
| 4,557,195 | 12/1985 | Phlipp | 101/163 |
| 5,003,872 | 4/1991 | Dalferth | 101/163 |

FOREIGN PATENT DOCUMENTS

| | | | |
|---|---|---|---|
| 1923374 | 2/1970 | Fed. Rep. of Germany | 101/163 |
| 2205430 | 6/1981 | Fed. Rep. of Germany | 101/163 |
| 1135819 | 1/1969 | United Kingdom | 101/163 |

*Primary Examiner*—Edgar S. Burr
*Assistant Examiner*—Ren Yan
*Attorney, Agent, or Firm*—Bell, Seltzer, Park & Gibson

[57] ABSTRACT

An ink cup for a pad printer has a hollow body and a surface that contacts a die plate on the pad printer, the contact surface being formed from bronze. In a preferred embodiment, the bronze used to form the contact surface of the ink cup is a copper alloy consisting of 83% copper, 7% lead, 7% tin, and 3% zinc. The ink cup has a flange between the hollow body of the cup and the contact surface. The ink cup flange, which extends outward from the hollow body, has a curved outer surface. A retaining ring having a diameter greater than that of the ink cup flange, has a curved inner surface adapted for receiving the ink cup flange to maintain the ink cup in contact with the die plate while permitting the ink cup to rock within the retaining ring.

4 Claims, 2 Drawing Sheets

INK CUP FOR A PAD PRINTER

The present invention relates to pad printers and in particular to improvements in ink cups for pad printers.

BACKGROUND TO THE INVENTION

Pad printers are used for printing on irregular surfaces. In some forms of pad printers the ink is pumped into an ink tray which is exposed to the atmosphere. However, since the ink is thinner-based its viscosity increases over time to an unacceptable level due to the evaporation of the thinner. One means that has been devised to overcome this problem is to provide a cup to contain the ink so that the ink is not exposed to the atmosphere. Cups that are made of nylon or similar plastics material are known, as are cups made of hardened steel. The former are unsatisfactory in that they tend to distort and so cause uneven application of ink. The latter are expensive to manufacture and have a tendency to damage the die plate.

BRIEF SUMMARY OF THE INVENTION

It is an object of the invention to provide an improved ink cup for pad printers.

This and other objects of the invention as will hereafter become more readily apparent have been achieved by providing an ink cup for a pad printer which is made from bronze. Preferably the bronze used to make the cup is known as Copper Alloy C93200 and it comprises for preference 83% Copper, 7% lead, 7% tin and 3% Zinc.

In a preferred embodiment, the cup is provided with an outwardly extending flange at its open end. The flange has a slightly curved surface which is designed to contact a similarly profiled inner surface of a retaining ring which, in use, maintains the ink cup in contact with the die plate. The diameter of the inner surface of the retaining ring is preferably about 0.1% greater than the radius of the curved contact surface of the flange. This feature permits the ink cup to "rock" slightly within the retaining ring so as to compensate for the very slight undulating movement of the die plate as it moves back and forth under the ink cup. A preferred size for the diameter of the ink cup to the mid point of the curved contact surface is 50 mm.

The advantages of the ink cup of the present invention are that the ink is completely contained within the cup and is not exposed to the atmosphere. This not only maintains the viscosity of the ink at the desired level, but means that the ink remains free of dust and other air-borne contamination. Additionally the printing process can be run continuously for over 24 hours as no interruptions are required to test and adjust the viscosity of the ink. The bronze cup has the particular advantage over known cups in that it causes little wear to the die plate so extends the life of the latter. It can also be readily and accurately manufactured and in particular the curved contact surface can be very accurately machined by computer numerical control (CNC) lathe.

In operation the ink cup is placed in contact with a die plate and held in place on the die plate by means of the retaining ring. The retaining ring presses the ink cup against the die plate by means of a spring through a retainer slide which is located within a slide housing. The die plate moves backwards and forwards under the ink cup and a constant pressure is maintained between the ink cup and the die plate due to the curved contact surface of the flange of the ink cup and the similarly profiled inner surface of the retaining ring.

It is also contemplated that rather than the die plate's moving under the ink cup, the ink cup could be moved over a stationary die plate.

BRIEF DESCRIPTION OF THE DRAWINGS

The invention will be described, by way of example, with reference to the accompanying drawings in which.

DESCRIPTION OF THE PREFERRED EMBODIMENT

Figure 1:
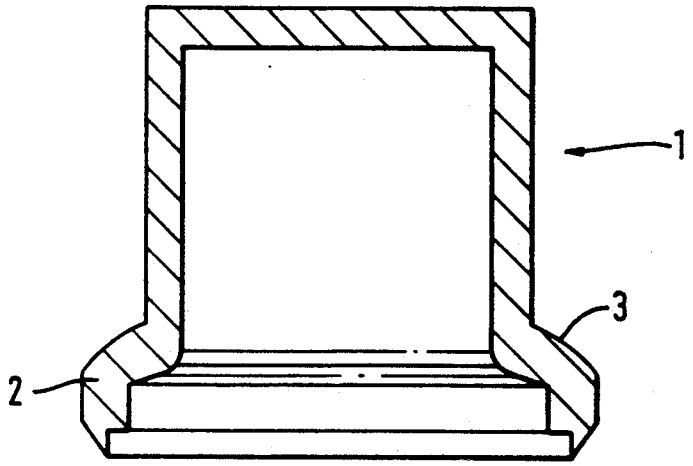
FIG. 1 is a cross-section through an ink cup in accordance with the present invention.

In FIG. 1 an ink cup, shown generally as 1, has a flange 2 with slightly curved contact surface 3.

Figure 2:
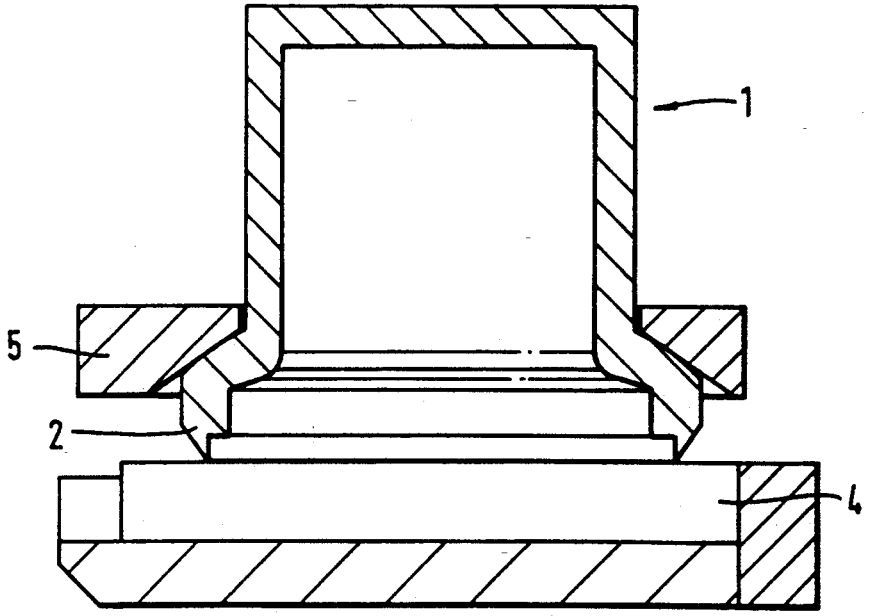
FIG. 2 is a cross-section through an ink cup and retaining ring showing the ink cup in place on a die plate, in accordance with the present invention.

FIG. 2 shows the cup 1 held in place on a die plate 4 by means of a retaining ring 5.

Figure 3:
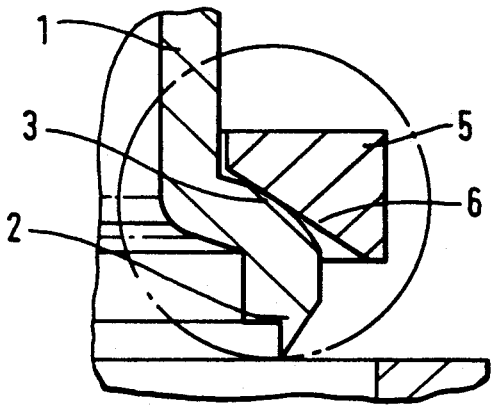
FIG. 3 shows the circled portion of FIG. 2 enlarged.

FIG. 3 shows in enlargement the curved contact surface 3 of the ink cup 1 which engages a similarly profiled but slightly larger inner surface 6 of the retaining ring 5.

Figure 4:
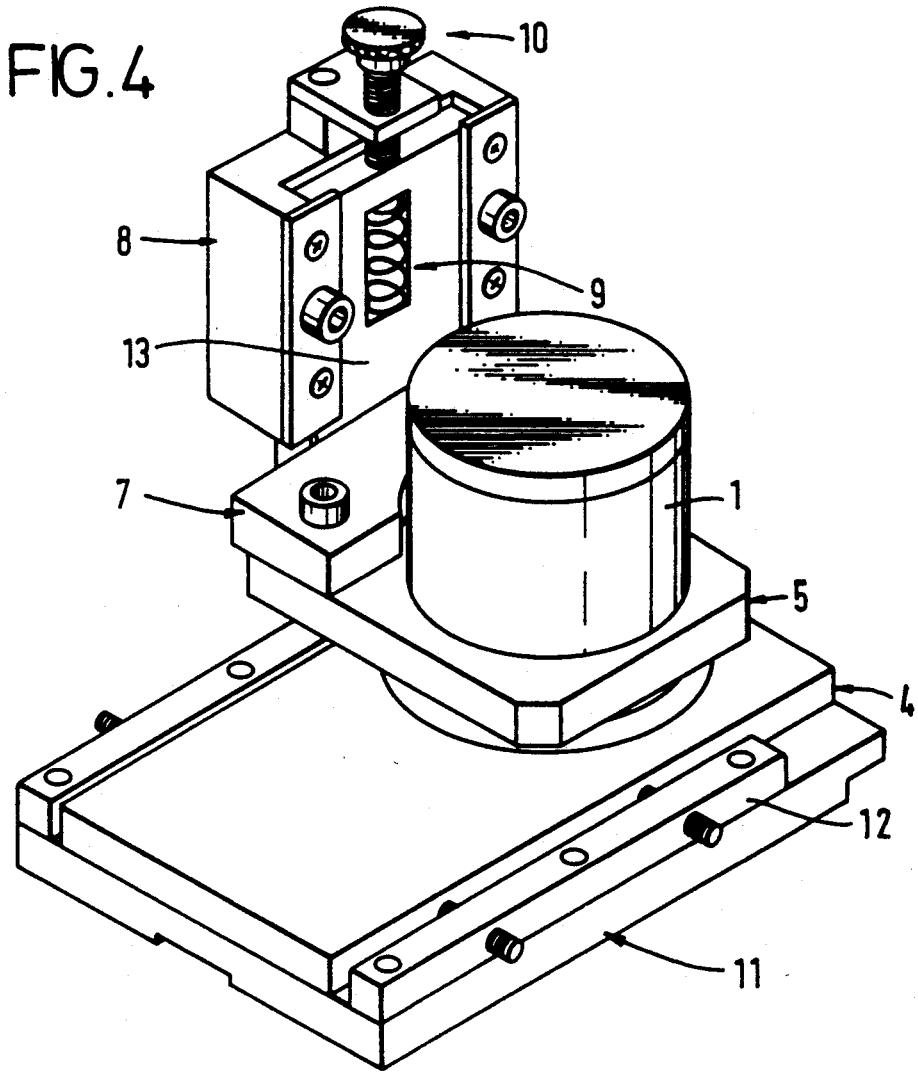
FIG. 4 shows a perspective view of an ink cup in accordance with the present invention in place on a die plate.

As shown in FIG. 4 the ink cup 1 is held in place on the die plate 4 by means of the retaining ring 5 which is attached to a bracket 7, which is affixed to a retainer slide 13 which is located in a slide housing 8. The retainer slide 13 accommodates a spring 9 which presses the ink cup 1 into contact with the die plate 4. The pressure of the spring 9 can be adjusted by means of a pressure adjustment screw 10. The die plate 4 is affixed to a die plate platform 11 by means of a locking bar 12.

In operation the ink cup 1 is placed in contact with a die plate 4 and held in place on the die plate 4 by means of the retaining ring 5. The retaining ring 5 presses the ink cup 1 against the die plate 4 by means of a spring 9 through a retainer slide 13 which is located within a slide housing 8. The die plate 4 moves backwards and forwards under the ink cup 1 and a constant pressure is maintained between the ink cup 1 and the die plate 4 due to the curved contact surface of the flange of the ink cup 1 and the similarly profiled inner surface of the retaining ring 5.

A latitude of modification, change and substitution is intended in the foregoing disclosure and in some instances some features of the invention will be employed without a corresponding use of other features. Accordingly, it is appropriate that the appended claims be constructed broadly and in a manner consistent with the spirit and scope of the invention herein.

I claim:

1. An ink holding apparatus for a pad printer comprising:

an ink cup having a hollow body for holding ink, a contact surface for contacting a die plate on the pad printer, and an outwardly extending flange having a curved outer surface; and a retaining ring having an inner surface, wherein the inner surface of said retaining ring is curved for receiving the curved outer surface of the outwardly extending flange of the ink cup to maintain the ink cup in contact with the die plate while permitting the ink cup to rock within the retaining ring.

2. The ink holding apparatus according to claim 1 wherein the diameter of the curved inner surface of the retaining ring is slightly greater than the diameter of the curved outer surface of the outwardly extending flange of the ink cup.

3. The ink holding apparatus according to claim 2 wherein the diameter of the curved inner surface of the retaining ring is about 0.1% greater than the radius of the curved outer surface of the outwardly extending flange of the ink cup.

4. The ink holding apparatus according to claim 1 wherein the diameter of the ink cup measured to the mid point of the contact surface is 50 mm.

* * * * *